US005935279A

United States Patent [19]

Kilström

[11] Patent Number: 5,935,279

[45] **Date of Patent: *Aug. 10, 1999**

[54] REMOVABLE CYCLONE SEPARATOR FOR A VACUUM CLEANER

[75] Inventor: Lars Kilström, Täby, Sweden

[73] Assignee: Aktiebolaget Electrolux, Stockholm, Sweden

[ * ] Notice: This patent is subject to a terminal disclaimer.

[21] Appl. No.: 08/978,224

[22] Filed: Nov. 25, 1997

[30] Foreign Application Priority Data

Dec. 18, 1996 [SE] Sweden ..... 9604657

[51] Int. Cl.[6] ..... B01D 50/00

[52] U.S. Cl. ..... 55/337; 55/429; 55/DIG. 3; 15/350; 15/353

[58] Field of Search ..... 55/318, 337, 385.1, 55/429, DIG. 3, 319; 15/347, 350, 353, 328

[56] References Cited

U.S. PATENT DOCUMENTS 3,621,640 11/1971 Ohno et al. ..... 15/328

5,135,552 8/1992 Weistra ..... 55/337

5,779,745 7/1998 Kilstrom ..... 55/337

*Primary Examiner*—Jay H. Woo

*Assistant Examiner*—Robert Hopkins

*Attorney, Agent, or Firm*—Pearne, Gordon, McCoy & Granger LLP

[57] ABSTRACT

An accessory for a vacuum cleaner having a vacuum source (21) and an inlet tube (18) or the like entering into a chamber (15), the inlet tube communicating with a nozzle opening (11) and being normally connected to a dust container (16), the chamber having an opening which is normally covered by a lid (17). The accessory is a separate unit which is removable secured to the vacuum cleaner and includes a cyclone separator. The accessory has an inlet side (32) that can be connected to the inlet tube (18). The accessory has a liner (25) to which a container part (27) is removably secured. The container part includes a first container (45) in which particles separated by the cyclone are collected and a second container (46) operable to collect particles separated by a coarse separator.

11 Claims, 6 Drawing Sheets

REMOVABLE CYCLONE SEPARATOR FOR A VACUUM CLEANER

BACKGROUND OF THE INVENTION

1. FIELD OF THE INVENTION

The present invention relates to an accessory for a vacuum cleaner wherein the vacuum cleaner has a vacuum source and an inlet tube or the like ending in a chamber. The inlet tube communicates with a nozzle opening and is normally connected to a dust container. The chamber having an opening which is normally covered by a lid. The accessory is a separate unit which can be removably fixed to the vacuum cleaner. The separate unit includes a cyclone separator that is shaped so that its inlet side can be connected to the inlet tube.

2. DESCRIPTION OF RELATED ART

Vacuum cleaners are commonly classified as either upright-type vacuum cleaners or a canister-type vacuum cleaners. Upright vacuum cleaners usually are provided with a lower, wheel supported part having a brush roll which is placed at the nozzle opening and drive means for the brush roll. The lower part of the vacuum cleaner is, by means of a link mechanism, connected to an upper part, which includes a chamber for a dust container. An upper portion of the upper part is shaped as a handle by means of which the vacuum cleaner is guided on the floor. The vacuum source, which usually comprises an electrically driven fan unit, may be placed in either the upper part or the lower part.

Canister vacuum cleaners comprise a shell enclosing a motor-fan unit and a chamber in which a dust container is disposed. An inlet tube ending in the chamber is, for this type of vacuum cleaner, connected to a nozzle opening of a separate cleaning nozzle by means of a hose.

It is previously known to integrate cyclone separators with conventional canister-type vacuum cleaners, see for instance EP-A-489468. These integrated or combined canister vacuum cleaners, however, suffer from the disadvantage that the size of the vacuum cleaner increases since there is a demand for a container for the conventional filter bag and also a container for the material separated by the cyclone separator.

Cyclone vacuum cleaners of the upright type have also been developed, see for instance EP-B-489565. In these vacuum cleaners, the upper part is shaped as a cyclone separator forming an integrated part together with the motor-fan unit whereby at least heavier particles are separated from the air by the cyclone and fall down into a collecting container from which they may be manually removed. This type of vacuum cleaner has certain disadvantages: large flow resistance with accompanying demands for larger power of the electric motor of the vacuum source in order to achieve the same suction efficiency in the nozzle part as a conventional vacuum cleaner; unhygienic emptying of the dust container; and, high production costs. However, a cyclone separator may be advantageous for certain cleaning tasks. For example, a cyclone separator might be useful when it is desirable to pick up large volumes of easily separable material, such as coarse sand, and in circumstances wherein the consumption of dust containers in a conventional vacuum cleaner would be large.

Thus, it has been suggested, see SE 9504682-7, to use an accessory by means of which the vacuum cleaner can be simply converted from a conventional vacuum cleaner with a dust bag into a cyclone vacuum cleaner so that the vacuum cleaner can be adapted to the material to be removed from the floor.

However, the arrangement shown in the lastmentioned publication has a disadvantage since emptying and cleaning of the accessory is troublesome because the cyclone, a coarse separator connected to the cyclone, air channels, filters and container are combined into one single unit whose inner parts are solely accessible from an opening at the bottom of the containers. Accordingly there exists a need in the art for a cyclone separator accessory that is easy to empty and clean.

SUMMARY OF THE INVENTION

The present invention is directed toward a cyclone separator accessory which is easy to empty and clean. The present invention is further directed toward an cyclone separator accessory for a vacuum cleaner which can be easily installed on the vacuum cleaner in place of the conventional dust filter bag.

In accordance with the present invention, an accessory for a vacuum cleaner is a separate unit which is adapted to be removably secured to the vacuum cleaner. The separate unit includes a cyclone separator and has an inlet (32) adapted to be connected to an inlet tube provided by the vacuum cleaner.

In further accordance with the present invention, the separate unit comprises a liner (25) to which a container part (27) is removably secured. The container part provides a first container (45) in which particles separated by the cyclone are collected. The separate unit also provides a coarse separator and a second container (46). The second container collects particles separated by the coarse separator is integrally formed with the container part (27). Preferably, the first and second containers (45,46) are disposed side-by-side in the container part (27) and are separated from one another by an intermediate wall (47).

In further accordance with the present invention, the liner comprises an inlet channel (33), an intermediate channel (36), and a cyclone housing (35) defining a cyclone chamber. The inlet channel extends from the inlet to the second container. The intermediate channel connects the second container with the cyclone chamber and extends from an inlet opening (38) in the second container to an outlet opening (37) which issues tangentially into the cyclone chamber. The cyclone chamber has a centrally located outlet opening (41).

In further accordance with the present invention, the first container (45) includes a lower cyclone part (48) having a tube shaped, up-side-down truncated cone that defines a lower opening (51) through which separated particles fall down into the first container (45). The second container (46) includes a grating (56) disposed between an interior of the second container and the intermediate channel (36). The grating (56) is movable to permit emptying of the container part.

In further accordance with the present invention, a sealing plate (39) is disposed between surfaces of the container part (27) and the liner (25). The sealing plate surrounds an outlet opening (34) of the inlet channel (33) issuing into the second container (46), and the inlet opening (38) of said intermediate channel (36) leading from said second container. The sealing plate also surrounds and seals a connection between the cyclone housing and a cyclone part provided by the container part.

In further accordance with the present invention, the container part (27), via a hinge member (28,29), is pivotally secured to the liner. The hinge member (28,29) is arranged at one of the edge parts of the container part. A locking means, preferably in the form of a snap fastening mechanism (30,31), is arranged at an opposite edge portion of the container part and cooperates with a surface provided by the liner to releasably secure the container part to the liner.

BRIEF DESCRIPTION OF DRAWINGS

These and further features of the present invention will be apparent with reference to the accompanying drawings, wherein.

DETAILED DESCRIPTION OF THE PREFERRED EMBODIMENT

Figure 1A:
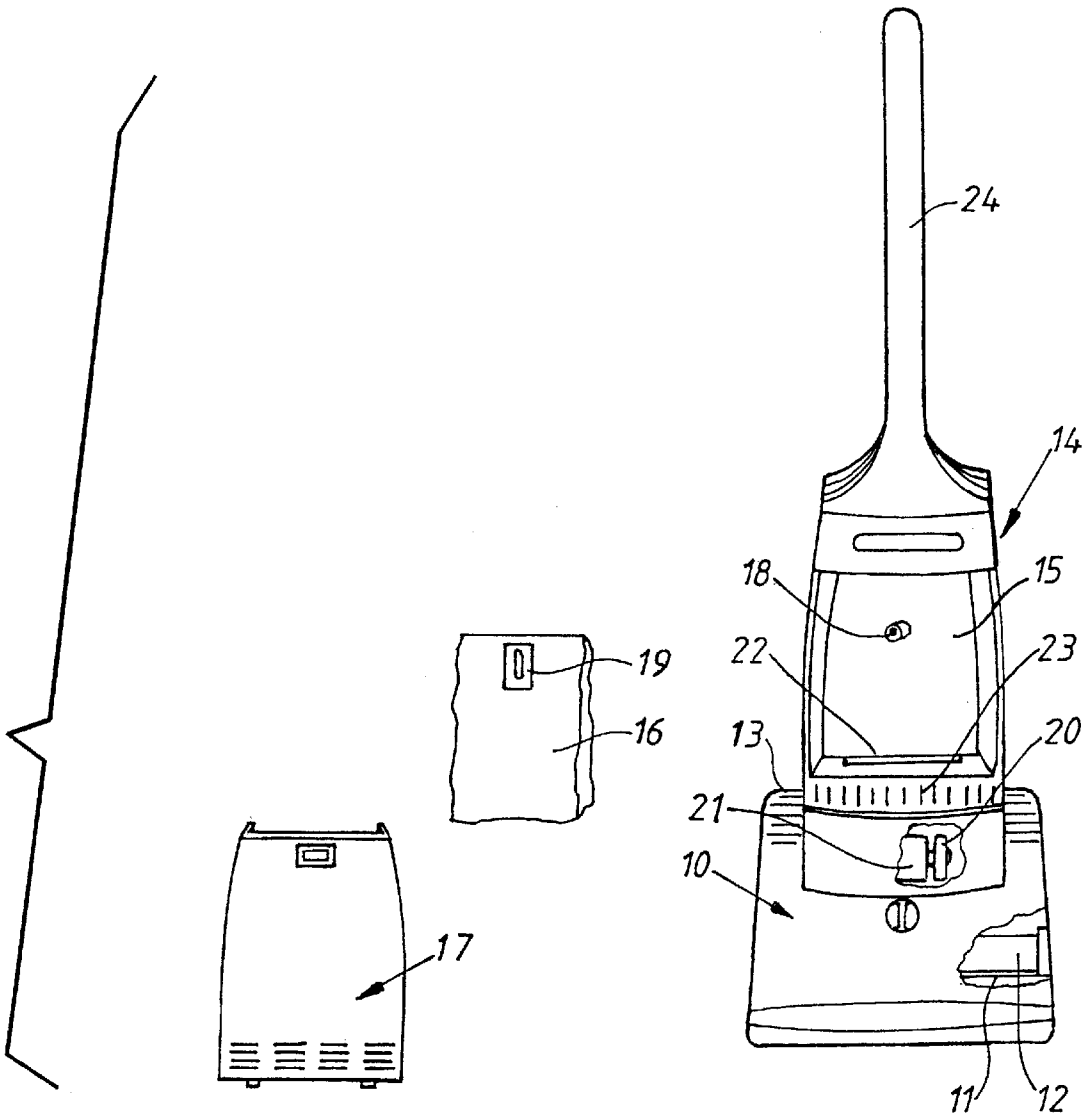
FIG. 1 is an exploded perspective view of a vacuum cleaner, a lid and dust bag removed from the cleaner to expose a chamber, and with an accessory according to the present invention, which replaces the lid and dust bag in the chamber, likewise removed from the chamber.

With reference to FIG. 1, a vacuum cleaner includes a lower part 10 with a nozzle opening 11 in which a brush roll 12 is rotatably arranged and powered, by means of an electric motor (not shown). The lower part 10 is supported by rear wheels 13 and front wheels, (not shown).

The lower part 10 is, by means of a pivot part, connected to an upper part 14. The upper part 14 cooperates with a removable lid 17 to define a chamber 15 for receipt of a dust container 16. The nozzle opening 11 at the lower part 10 communicates with an inlet tube 18 to which a collar 19 of the dust container 16 with its inlet opening can be connected. The lower portion of the upper part 14 forms a motor spacing 20 in which a motor-fan unit 21 is disposed. An inlet side of the fan unit 21 communicates with the chamber 15 by means of an opening 22 whereas an outlet side of the fan unit 21 is connected to an outlet part having diffusor openings 23 through which the filtered air flowing from the vacuum cleaner leaves to atmosphere. The upper portion of the upper part 14 is shaped as a shaft 24 with a handle by means of which the vacuum cleaner is moved on the surface being cleared.

Figure 2:
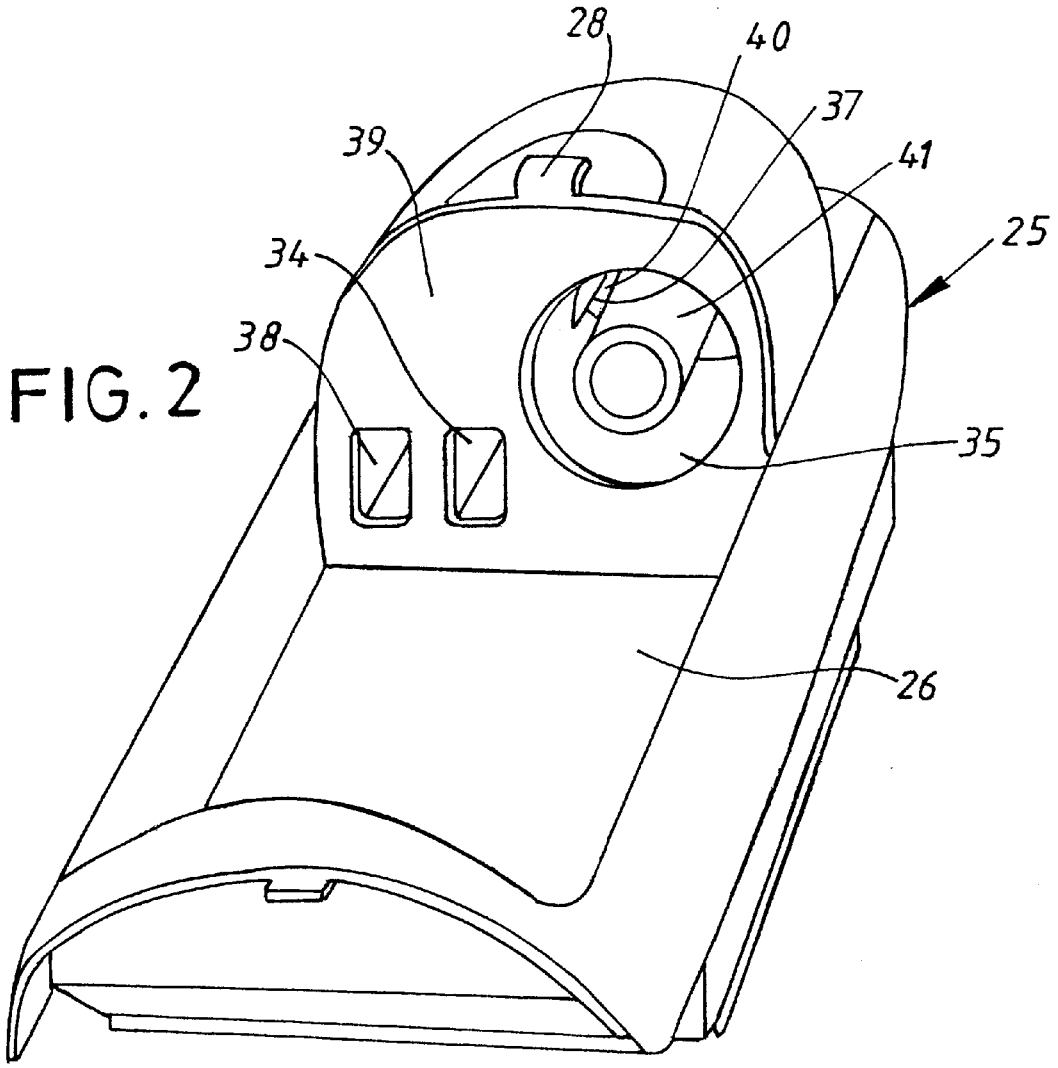
FIG. 2 is a perspective view of a liner that is adapted to be inserted into the vacuum cleaner chamber.
Figure 3:
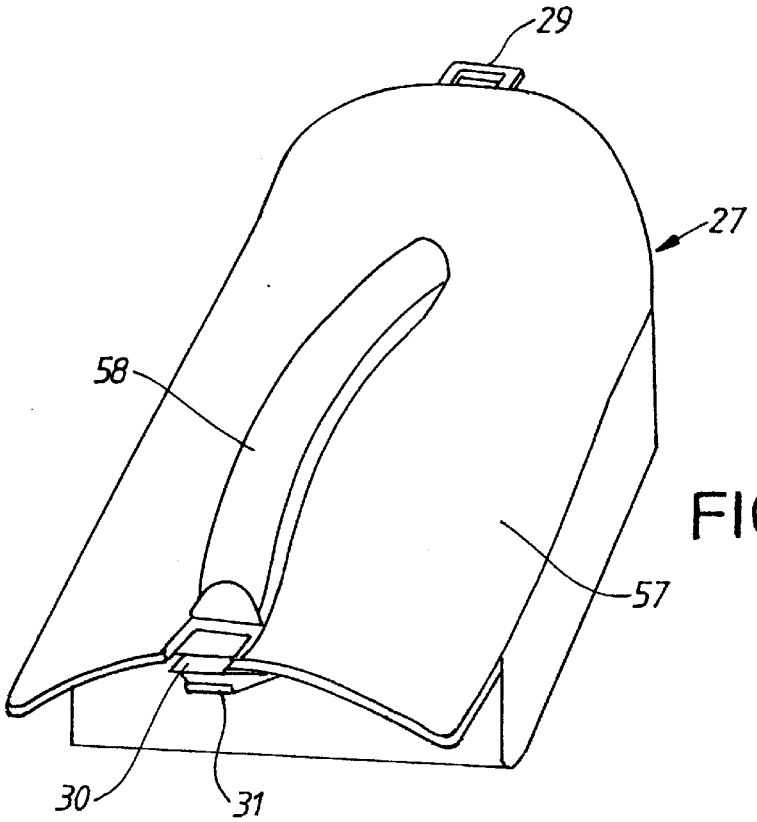
FIG. 3 is a perspective view of a container part that is adapted to be removably secured to the liner of FIG. 2.
Figure 4:
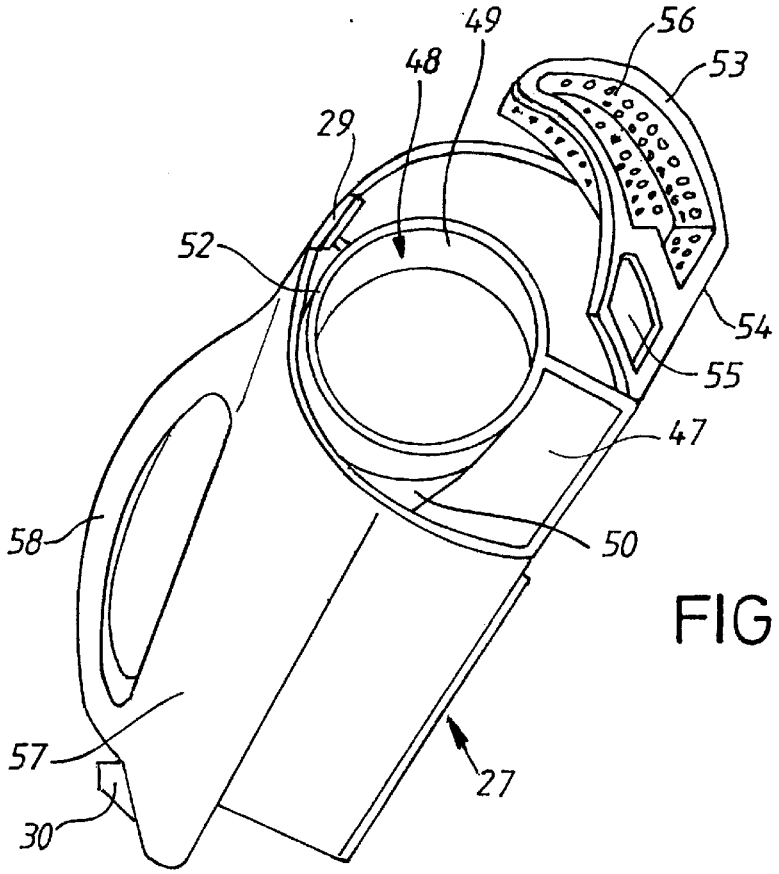
FIG. 4 is a further perspective view of the container part of FIG. 3, with a plate shown in a partially pivoted position.
Figure 5:
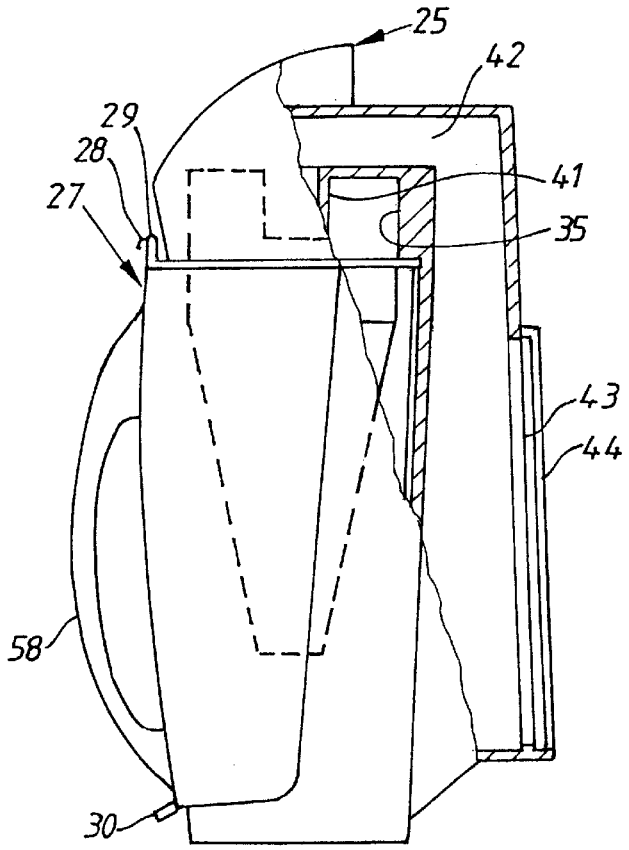
FIG. 5 is a partially broken side view of the liner with the container part inserted in the liner.
Figure 6:
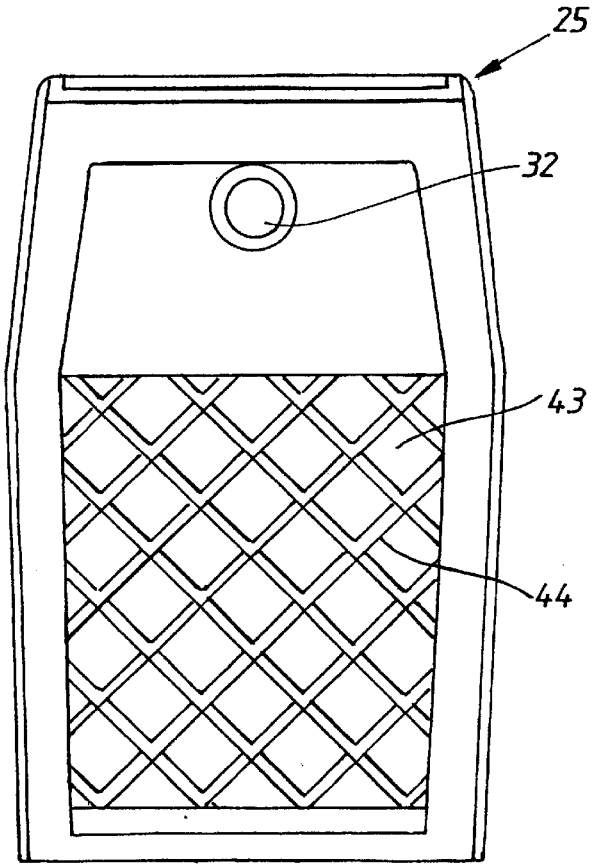
FIG. 6 is a rear elevational view of the liner.
Figure 7:
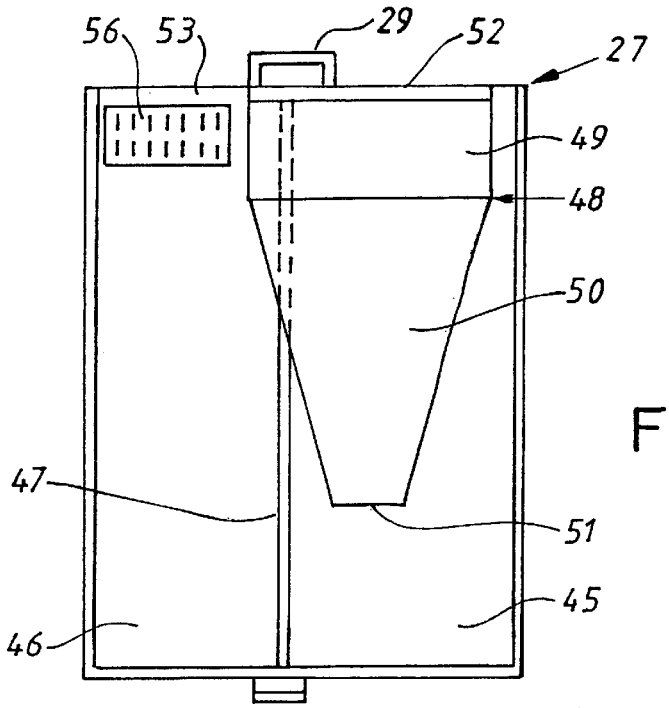
FIG. 7 is a front elevational view of the container part with the front wall removed for clarity; and, FIG. 8 is a front elevational view of the liner with the container part removed for clarity.
Figure 8:
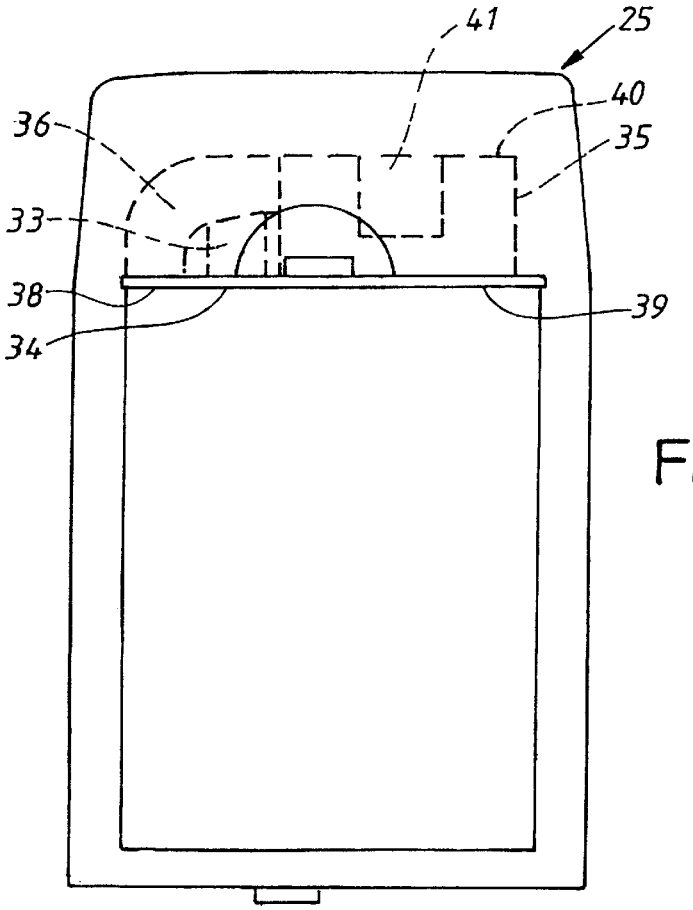

A liner 25 can be removable secured in the chamber 15 by means of a locking means (not shown). The liner 25 (FIG. 2) comprises a trough-shaped space 26 in which a container part 27 is removably secured. The container part 27 is secured to the liner 25 by means of a hook 28 on the liner 25 which cooperates with a loop 29 on the container part 27 to define a hinge member. As such, the container part 27 can be rotated or pivoted into the trough-shaped space 26 when the hook 28 and loop 29 have been brought into engagement with one another. The container part 27 also is provided with snap fastening mechanism including a locking tongue 30 having a shoulder 31 engaging an abutting surface on the liner 25 in order to lock the container part 27 to the liner 25.

With reference to FIGS. 2–8, the liner 25 has at its rear side an inlet 32 to a channel 33 whose outlet 34 ends in the space 26. The inlet 32 is adapted to fit over the inlet tube 18. The channel 33 is curved, and extends from the generally centrally located inlet 32, which is in a vertical plane, to the laterally located outlet 34, which is in a horizontal plane. The outlet 34 is spaced laterally and downwardly from the inlet 32.

The liner 25 also encloses a cyclone housing 35 comprising a circular chamber which, via a channel 36 having an inlet 38, is connected to the space 26. An outlet 37 of the channel 36 is directed such that air flows mainly tangentially into the cyclone housing 35 whereas the inlet 38 of the channel 36 faces the space 26. Similar to the channel 33, the channel 36 is curved and extends from the tangential outlet 37, which is in a generally vertical plane, to the inlet 38, which is in a generally horizontal plane. The inlet 38 is spaced laterally and downwardly from the outlet 37. The inlet 38, the outlet 34, and the lower end of the cyclone housing 35 are placed in the same parting plane and are surrounded by a common sealing plate 39 covering an upper wall in the space 26. The sealing plate 39 preferably includes an elastomeric sealing gasket to permit formation of an air-tight seal between the various air passageways extending between the liner 25 and the container part 27, to be described hereinafter.

The cyclone housing 35 has an upper wall 40 supporting a centrally placed tube 41 forming an outlet for air which is drawn through the cyclone housing 35. The tube 41 is connected to an air passage 42 having one or more outlet openings covered by a filter 43. A grating 44 is provided over the filter 43 and serves to keep the filter 43 in place. By positioning the liner 25 in the chamber 15 (FIG. 1), the liner inlet 32 sealingly encloses the inlet tube 18, while the liner 25, in the same manner as the cover 17, (now removed) closes the outwardly facing opening of the chamber 15.

The container part 27, which is shown best in FIGS. 3–5 and 7, comprises a first container 45 and a second container 46 which are separated by a vertical intermediate wall 47. The wall 47 may be removable from the container part 27 or may be fixedly secured therein. The intermediate wall 47 supports a pipe 48 having an upper part 49 shaped as a circular cylinder and a lower part 50 shaped as an up-side-down truncated cone. The lower part 50 has a relatively smaller, lower opening 51 facing the first container 45 and a relatively larger, upper opening which is placed in the parting plane and sealingly joins the cyclone housing 35 when the container part 27 is inserted into the space 26. Preferably, the intermediate wall 47 and pipe 48 are integrally formed as a single piece, and the wall 47 adjoins the pipe 48 such that the pipe 48 projects partially into both containers 46, 47.

The second container 46 has, at its upper opening, a plate or coarse separator 53 which is pivotally arranged at the edge 54 of the opening. Preferably, the plate 53 is integrally formed with a rear wall of the container part 27 and is pivotally arranged by means of a living hinge. The plate 53 has an opening 55 which, when the container part 27 is fixed into the liner 25, joins the outlet 34 of the channel 33 of the liner 25. The plate 53 defines a basket-shaped perforated grating 56 which, in the lastmentioned position, covers the inlet 38 of the channel 36. Thus, the plate 53 abuts the sealing plate 39 of the liner 25 such that a complete sealing is formed at the parting plane between the two containers 45,46 and the liner 25. A front wall 57 of the container part 27 is preferably manufactured from a transparent plastic material and has a handle 58 which serves as a grip when the container part 27 is emptied and also when handling the liner 25 when the liner 25, together with the container part 27, is removed from the vacuum cleaner.

The device operates in the following manner. When the fan unit 21 is started air is drawn from the nozzle opening 11 through the inlet tube 18, the inlet 32, the channel 33, and the outlet 34 and downwardly into the second container 46. The air reverses direction in the second container 46, and flows upwardly through the grating 56 which covers the inlet 38 to the channel 36.

This means that as the dirty air enters the second container 46, the air velocity drops and relatively heavier particles are separated from the air stream and fall under the influence of gravity downwards toward the bottom of the second container 46. Relatively lighter particles, such as paper, continue with the air stream and, as the air stream passes through the grating 56, the larger ones of these particles are removed from the air stream by the filtering action of the grating 56. The partially-clean air then flows through the inlet 38, the channel 36, and the outlet 37 tangentially into the cyclone housing 35. A vortex is created in the cyclone housing 35 and in the pipe 48 whereby smaller particles, by influence of centrifugal force and gravity, are separated from the air stream and fall down through the opening 51 in the lower part 50 of the pipe 48 toward the bottom of the first container 45. The air then leaves through the tube 41, the air passage 42, and the filter 43 to the chamber 15 from which the air flows further through the opening 22 to the fan unit 21 from which it then leaves to atmosphere via the diffusor openings 23.

When the container part 27 is being emptied, the locking tongue 30 is released and the container part 27 is pivoted outward and upwards before being released from the hook 28. By turning the complete container part up-side-down the plate 53 will swing out from its horizontal position thereby removing the obstruction of the opening so that the dust can fall out from the second container 46. Simultaneously the dust collected in the first container 45 also falls out through an opening beside the pipe 48. It is also possible to remove the intermediate wall 47 with associated pipe 48 from the liner which means that the two containers 45,46 become completely free for cleaning.

While the preferred embodiment of the present invention is completely and particularly described herein, it should be apparent that the present invention is capable of numerous modifications, alterations, additions, and replacements of parts and, therefore, is not limited to that which is disclosed herein. Rather, the present invention covers all devices which fall within the scope of the claims appended hereto.

What is claimed is:

1. An accessory for a vacuum cleaner, said vacuum cleaner comprising a vacuum source (21), a nozzle opening (11), and an inlet tube (18), said inlet tube (18) communicating with said nozzle opening (11) and ending in a chamber (15), said inlet tube (18) being normally connected to a dust container (16) and said chamber having an opening which is normally covered by a lid (17), said accessory being a separate unit which is adapted to be removably secured to the vacuum cleaner, said separate unit comprising a cyclone separator and having an inlet (32) adapted to be connected to said inlet tube (18), wherein said separate unit comprises a liner (25) to which a container part (27) is removably secured, said container part comprising a first container (45) in which particles separated by the cyclone are collected.

2. An accessory according to claim 1, wherein said separate unit also comprises a coarse separator and a second container (46), said second container being operable to collect particles separated by the coarse separator and being integrally formed with the container part (27).

3. An accessory according to claim 2, wherein the first and second containers (45,46) are disposed side-by-side in the container part (27) and are separated from one another by an intermediate wall (47).

4. An accessory according to claim 2, wherein the liner (25) comprises an inlet channel (33), an intermediate channel (36), and a cyclone housing (35) defining a cyclone chamber, said inlet channel extending from said inlet (32) to the second container, said intermediate channel connecting the second container with the cyclone chamber and extending from an inlet opening (38) in said second container to an outlet opening (37) which issues tangentially into said cyclone chamber, said cyclone chamber having a centrally located outlet opening (41).

5. An accessory according to claim 2, wherein the first container (45) comprises a lower cyclone part (48) having a tube shaped, up-side-down truncated cone defining a lower opening (51) through which separated particles fall down into the first container (45).

6. An accessory according to claim 2, wherein the second container (46) includes a grating (56) disposed between an interior of the second container and an intermediate channel (36), said grating (56) being movable to permit emptying of the container part.

7. An accessory according to claim 6, wherein the first and second containers are separated by an intermediate wall (47), said intermediate wall (47) being removably secured to the container part (27).

8. Accessory according to claim 4, further comprising a sealing plate (39) disposed between surfaces of the container part (27) and the liner (25) and surrounding an outlet opening (34) of said inlet channel (33) issuing into said second container (46) and said inlet opening (38) of said intermediate channel (36) leading from said second container.

9. Accessory according to claim 8, further comprising a lower cyclone part, and wherein said sealing plate also surrounds said centrally located outlet opening (41) and said lower cyclone part.

10. An accessory according to claim 1, wherein the container part (27) is pivotally secured to the liner by a hinge member (28, 29).

11. An accessory according to claim 10, wherein the hinge member (28,29) is arranged at one of the edge parts of the container part and wherein a locking means, in the form of a snap fastening mechanism (30,31), is arranged at an opposite edge portion of the container part and cooperates with a surface provided by the liner to releasably secure the container part to the liner.

* * * * *

UNITED STATES PATENT AND TRADEMARK OFFICE

CERTIFICATE OF CORRECTION

PATENT NO. : 5,935,279

DATED : August 10, 1999

INVENTOR(S) : Kilstrom

It is certified that error appears in the above-identified patent and that said Letters Patent is hereby corrected as shown below:

Column 3, Line 11, delete "FIG. 1" and insert --FIG. 1A--.

Figure 1B:
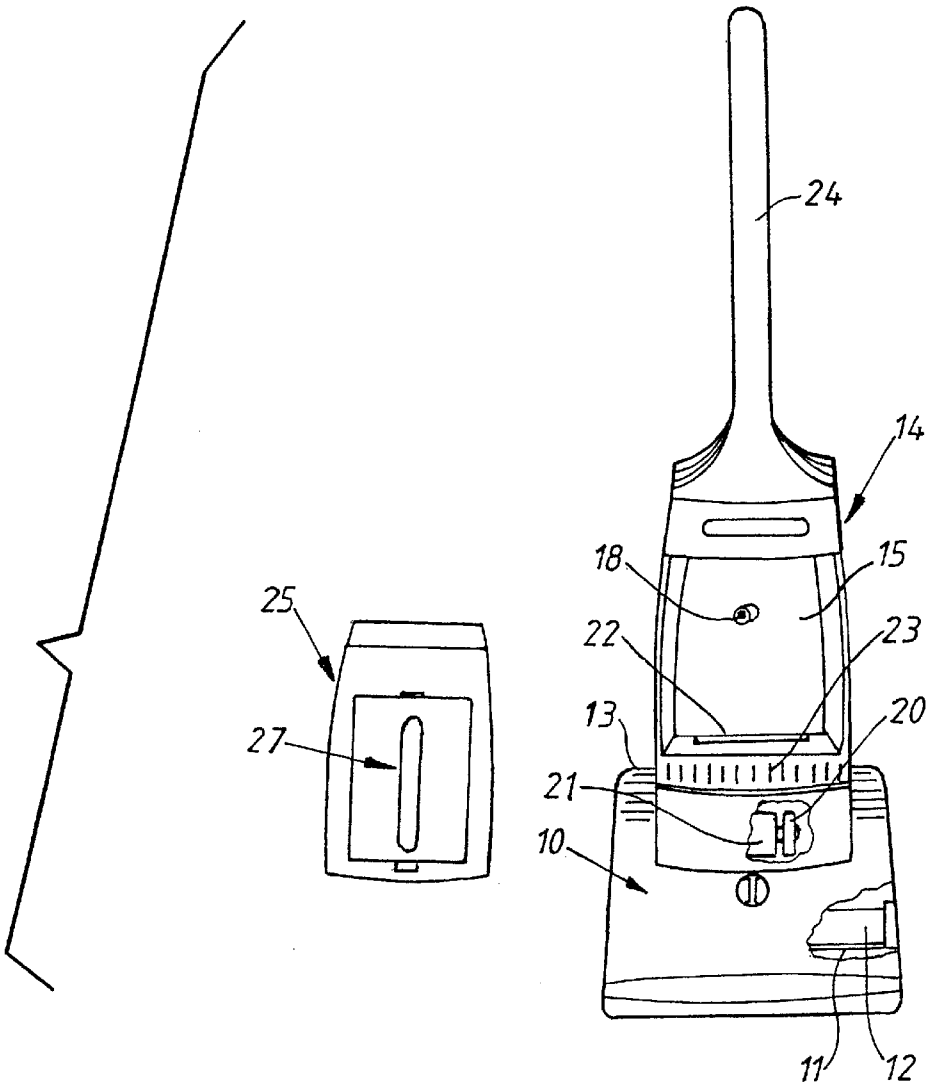

Column 3, Lines 13-15, delete "and with an accessory according to the present invention, which replaces the lid and dust bag in the chamber, likewise removed from the chamber;" and insert --FIG. 1B is an exploded perspective view of the vacuum cleaner with an accessory, which replaces the lid and the dust bag, and which is removed from the cleaner to expose the chamber;--.

Column 3, Line 34, delete "FIG. 1" and insert --FIG. 1A and FIG. 1B--.

Column 4, Line 33, delete "(FIG. 1)" and insert (FIG. 1A and FIG. 1B--.

Signed and Sealed this

Twenty-first Day of March, 2000

*Attest:*

*Attesting Officer*

Q. TODD DICKINSON

*Commissioner of Patents and Trademarks*